US005815950A

United States Patent [19]

Wang

[11] Patent Number: 5,815,950

[45] Date of Patent: Oct. 6, 1998

[54] AIR-CUSHIONING SOLE INSERT LINED WITH IRIDESCENT FILM

[76] Inventor: Sui-Mu Wang, P. O. Box 55-846, Taipei, Taiwan

[21] Appl. No.: 927,468

[22] Filed: Sep. 11, 1997

[51] Int. Cl.[6] ..... A43B 13/18; A43B 21/26

[52] U.S. Cl. ..... 36/29; 36/71; 36/137

[58] Field of Search ..... 36/28, 29, 35 B, 36/137, 71

[56] References Cited

U.S. PATENT DOCUMENTS

| | | | |
|---|---|---|---|
| 3,748,758 | 7/1973 | Wilchusky | 36/34 A |
| 4,817,304 | 4/1989 | Parker et al. | 36/29 |
| 5,034,084 | 7/1991 | Schafer et al. | 156/278 |
| 5,220,737 | 6/1993 | Edington | 36/29 |
| 5,353,459 | 10/1994 | Potter et al. | 36/29 |
| 5,363,570 | 11/1994 | Allen et al. | 36/29 |

*Primary Examiner*—M. D. Patterson

[57] ABSTRACT

A sole insert including: an iridescent film translucent or transparent lined on or in a transparent outer wall of an air-cushioning pad of a sole insert inserted in a shoe sole, and a color sheet covering and combinable with the air-cushioning pad, whereby upon a molding process of the pad with the color sheet to form a recess recessed in the pad and to form an inner wall revealing a background color inside the pad in contrast to the outer wall reflecting the iridescent colors from the iridescent film as lined on or in the outer wall. It will greatly enhance a decorative effect and visual interest for the wearer.

8 Claims, 4 Drawing Sheets

AIR-CUSHIONING SOLE INSERT LINED WITH IRIDESCENT FILM

BACKGROUND OF THE INVENTION

U.S. Pat. No. 5,188,447 to Chiang et al. disclosed an illuminating system including an insert disposed on or in the heel of a shoe, a piezoelectric member provided to produce a signal, an amplifier for amplifying the signal, and a plurality of light-emitting diodes illuminated as actuated by the amplified signal for illumination and decoration purpose.

However, such a shoe requires a power source of battery, and electronic circuits having the plural light-emitting diodes (LEDS), consuming electric energy when powered for lighting the LEDS.

If an inflated sole insert having air cushioning cells provided in a shoe sole, even the sole insert may be made optically transparent or translucent, it will not shimmer or produce shining and color changes in order to spur the wearer's interest and to enhance decorative meaning.

The present inventor has found the drawbacks of the conventional sole insert and invented the present sole insert having iridescent colors.

SUMMARY OF THE INVENTION

The object of the present invention is to provide a sole insert including: an iridescent film translucent or transparent lined on or in a transparent outer wall of an air-cushioning pad of a sole insert inserted in a shoe sole, and a color sheet covering and combinable with the air-cushioning pad, whereby upon a molding process of the pad with the color sheet to form a recess recessed in the pad and to form an inner wall revealing a background color inside the pad in contrast to the outer wall reflecting the iridescent colors from the iridescent film as lined on or in the outer wall, thereby greatly enhancing a decorative effect and visual interest for the wearer.

DETAILED DESCRIPTION

Figure 1:
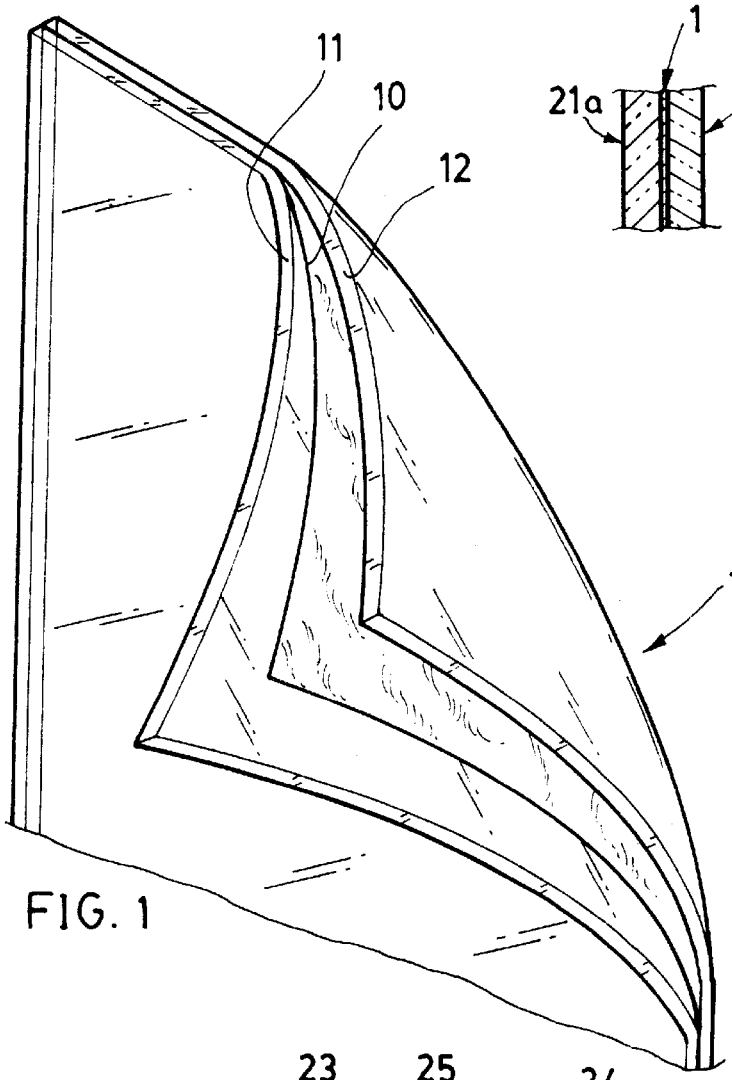
FIG. 1 is an illustration showing an iridescent film of the present invention.
Figure 2:
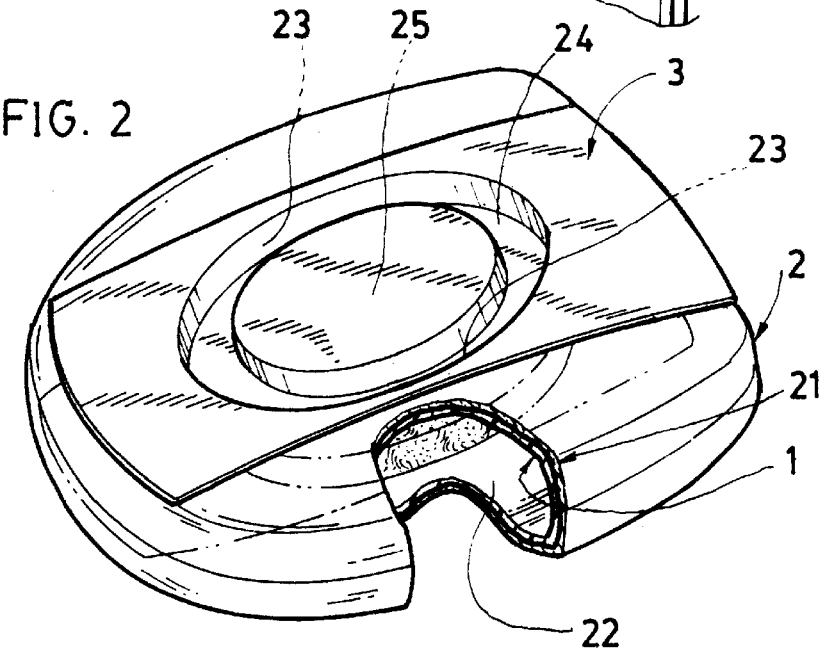
FIG. 2 is a perspective view of the present invention.
Figure 3:
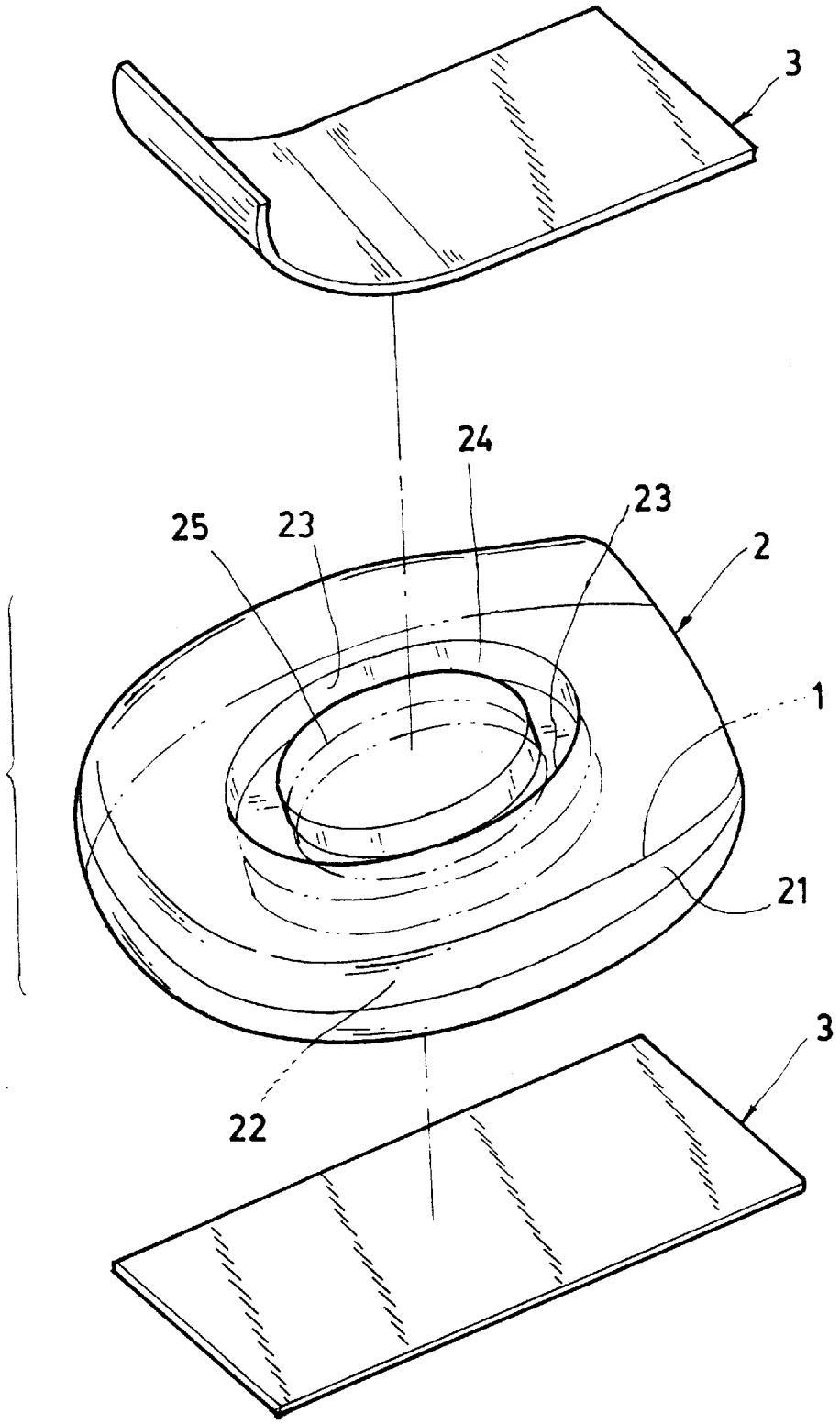
FIG. 3 is an exploded view of the present invention.

As shown in FIGS. 1–3, the sole insert of the present invention comprises: an iridescent film 1 translucent or transparent lined in an outer wall 21 of an air-cushioning pad 2 which is provided for a sole insert inserted, fixed, or embedded in a shoe sole 4 especially an air-cushioning sporting footwear, and at least a color sheet 3 combined or attached to the pad 2 for forming a "background color" of the sole insert in contrast to the colors as produced from the iridescent film 1 lined on or in the outer wall 21. The color sheet 3 may also reflect incident light outwardly through the sac 22.

The iridescent film 1 as shown in FIG. 1 includes: a laminated film 10 consisting of a plurality of (such as 5–7) transparent or translucent thin membranes laminated and superimposed one another for displaying a spectrum of colors or iridescent colors as reflected from the plural surfaces of the thin membranes that shimmer and change due to interference and scattering as the observer's (eyes) position changes; an outer transparent layer 11; and an inner transparent layer 12 with the laminated film 10 sandwiched in between the outer and inner transparent layers 11, 12 for protecting the laminated film 10 by the outer and inner transparent layers 11, 12. The film 1 may be made of polymethyl methacrylate, polystyrene, polyethylene, and other transparent thin film materials.

The air-cushioning pad 2 may be made of transparent materials and includes: an outer wall 21, an inner wall 23 juxtapositioned to the outer wall 21 to define a sac 22 having air or compressed air inflated therein between the outer wall 21 and the inner wall 23, at least an intermediate recess 24 recessed in an inner portion of the pad 2 contiguous to the inner wall 23, and at least an internal cell 25 formed in the inner portion of the pad 2 and partitioned from the sac 22 by the intermediate recess 24; with the outer wall 21 lined with the iridescent film 1.

Figure 4:
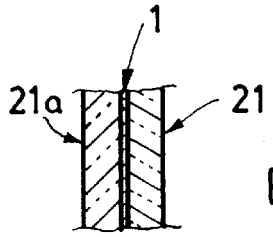
FIG. 4 is a partial sectional drawing of an outer wall of the present invention.

The iridescent film 1 may be lined on an inside wall of the outer wall 21 as shown in FIG. 2; or lined on an outside wall (not shown) of the outer wall 21; or the iridescent film 1 sandwiched between the outer wall 21 and a transparent back layer 21*a* as shown in FIG. 4; not limited in the present invention.

Naturally, the iridescent film 1 may also be lined within any side wall or any portion of the pad 2, not limited to be only lined in the outer wall 21.

As shown in FIG. 3, a pair of color sheets 3 having color pigments or dyes included in the color sheets 3 for forming contrast colors in contrast to the iridescent colors as produced by the iridescent film 1 as lined in the outer wall 21 of the pad 2 are disposed on an upper and a bottom side of the pad 2, whereby upon a molding process such as a thermoforming or vacuum-forming process, the two color sheets 3 are bonded together with the pad 2 for forming the intermediate recess 24, the internal cell 25, and the inner wall 23 which is colored by the color sheets 3.

Therefore, the iridescent colors from the iridescent film 1 on or in the outer wall 21 are synergetically combined with the contrast color from the inner wall 23 as backed by the color sheets 3 to form a three-dimensional colorful shimmering or shining to greatly enhance a decorative effect and visual interest for the wearer of the shoe inserted with the pad 2 of the present invention. For instance, a background color of red as indicated on the inner wall 23 by the color sheet 3 being commensurate with the outer iridescent colors (orange, yellow, purple, etc.) as reflected from the iridescent film 1 as lined in or on the outer wall 21 of the pad 2 will form a gradational multiple-color decorative effect.

The iridescent film 1 is translucent or transparent to thereby visually observe the "background color" of deep or contrast color as displayed by the inner wall 23 as backed by the color sheet 3.

Therefore, the present invention may produce shining iridescent colors without requiring any electronic circuits or illuminators for saving power and cost. Also, the iridescent color by the film 1 on the outer wall 21 and the background color by the color sheet 3 on the inner wall 23 will form colors of plural layers, increasing the gradational and three-dimensional optical decorative effect and interest, to thereby be superior to the prior art in this field.

The number and shapes of the recess 24, cell 25 and the pad 2 of the present invention are not limited, which may be modified by those skilled in the art.

Figure 5:
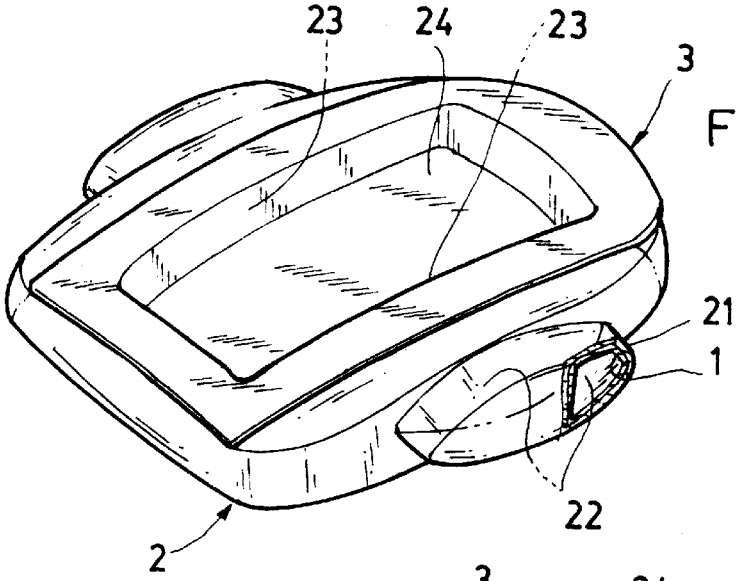
FIG. 5 is a perspective view of another preferred embodiment of the present invention.
Figure 6:
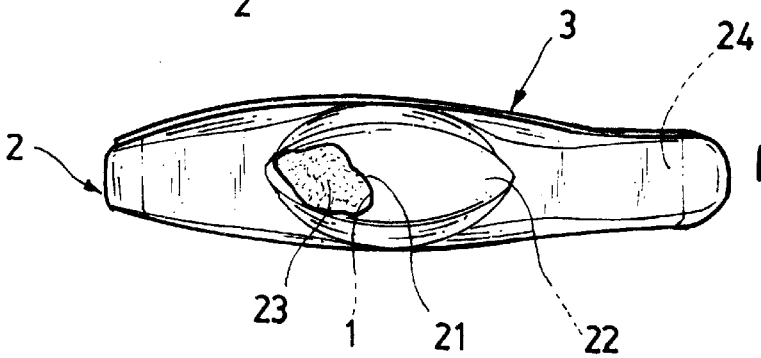
FIG. 6 is a front view of FIG. 5.
Figure 7:
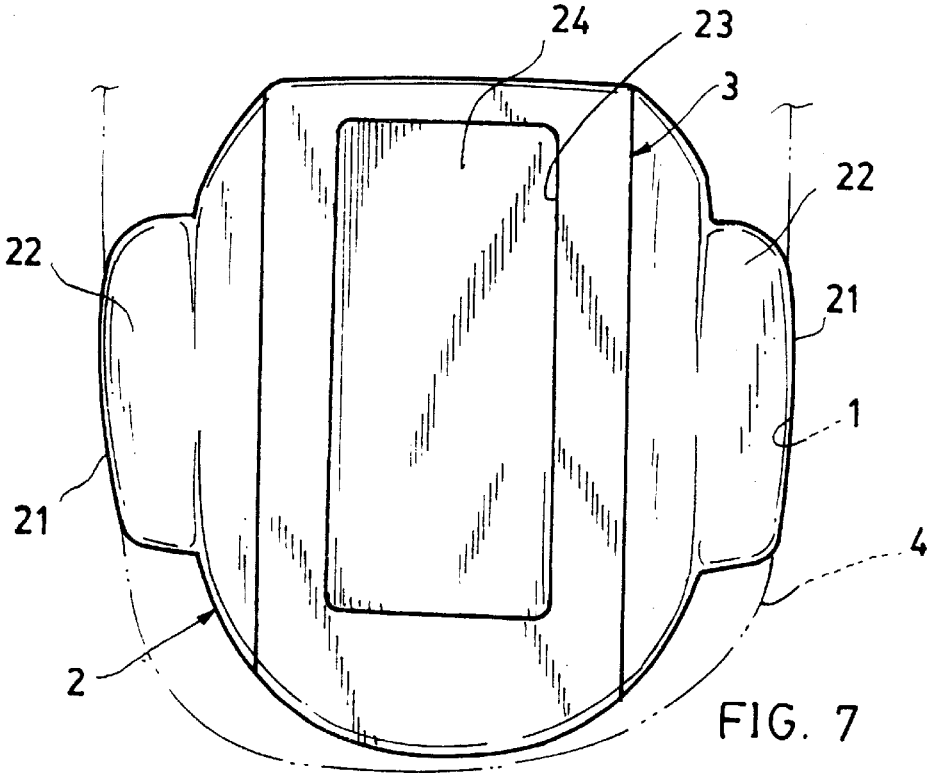
FIG. 7 is a top view of the FIG. 5.

As shown in FIGS. 5–7, the internal cell 25 is omitted, while the recess 24 is made larger. A single color sheet 3 is covered on the upper surface of the pad 2, subjected for molding process for combining and backing the color sheet 3 on the inner wall 23 for revealing a contrast or background color from the inner wall 23 to be commensurate with the iridescent color as produced from the iridescent film 1 as lined in the outer wall 21 of the pad 2. The sac 22 may be protruded transversely and outwardly beyond a shoe sole 4 to form two "ears" as illustrated in FIG. 7.

Figure 8:
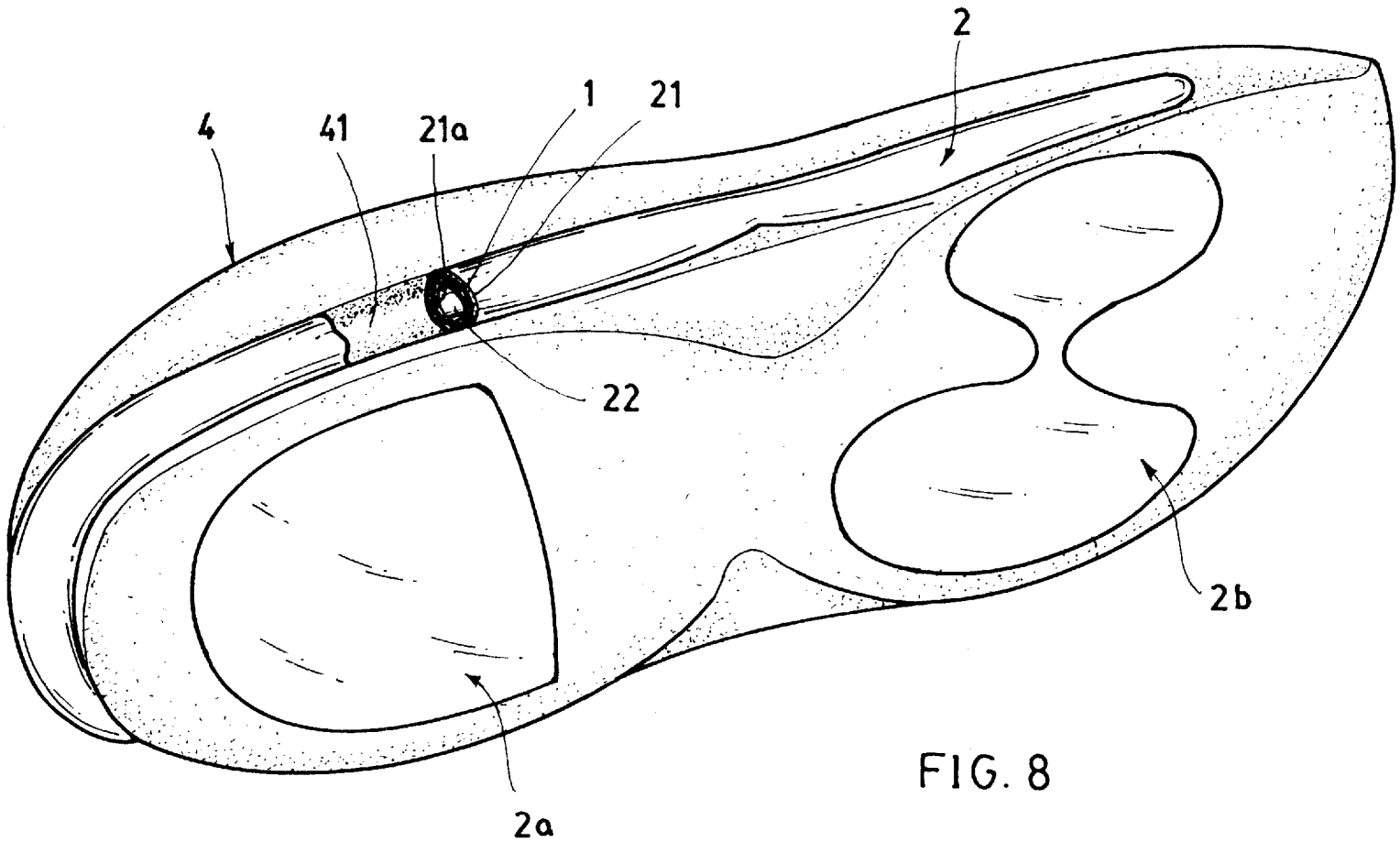
FIG. 8 is a perspective view of still another preferred embodiment of the present invention.

As shown in FIG. 8, the air-cushioning pads 2, 2*a,* 2*b* are embedded on or inserted in the sole 4 of a footwear. The pad 2 is disposed around a brim of the sole 4 and fixed in a socket 41 circumferentially recessed in the lower brim of the sole 4.

The air-cushioning pad 2 may be formed as an elongate sac 22 having an iridescent film 1 sandwiched in between an outer wall 21 and a back layer 21*a,* with the elongate sac 22 adhered on a contact surface of the socket 41 circumferentially recessed in the brim of the sole 4, the sole 4 being colored to form contrast color or background color in contrast to the iridescent colors as reflected from the iridescent film 1 lined in the outer wall 21 of the pad 2.

Naturally, the elongate sac 2 may be modified to be other shapes and structures. The background color is formed in situ in the sole 4 and will be projectively observed through the transparent outer wall 21 of the transparent pad 2 and will be synergetically "combined" with the iridescent colors as effected by the iridescent film 1 in the outer wall 21 of the pad 2 to have gradational, three-dimensional and colorful decorative effect.

The present invention may be modified without departing from the spirit and scope of the present invention. For instance, the sole insert 2 may also be directly integrally formed as a sole device of a footwear.

I claim:

1. A sole insert adapted for insertion in a footwear sole comprising:

an air-cushioning pad made of transparent material and having an outer wall, an inner wall juxtapositioned to said outer wall and a sac defined between said outer and inner walls;

an iridescent film lined with said outer wall of said air-cushioning pad for forming iridescent colors from said iridescent film; and at least a color sheet combined with said air-cushioning pad and backing said inner wall of said pad for forming a contrast and background color from said color sheet on said inner wall as being commensurate with the iridescent colors from said iridescent film on said outer wall for forming gradational multiple colors for enhancing decorative effect of the pad when observing through said outer wall, said sac and said inner wall of said air-cushioning pad.

2. A sole insert according to claim 1, wherein said iridescent film includes: a laminated film consisting of a plurality of transparent thin membranes laminated and superimposed one another for displaying a spectrum of iridescent colors as reflected from a plurality of surfaces of the thin membranes that shimmer and change due to interference and scattering as-an observer's position change; an outer transparent layer; and an inner transparent layer with the laminated film sandwiched in between the outer and inner transparent layers for protecting the laminated film between the outer and inner transparent layers.

3. A sole insert according to claim 1, wherein said air-cushioning pad includes: said outer wall, said inner wall juxtapositioned to the outer wall to define said sac therebetween, at least an intermediate recess recessed in an inner portion of the pad contiguous to the inner wall, and at least an internal cell formed in the inner portion of the pad and partitioned from the sac by the intermediate recess; with the outer wall lined with the iridescent film.

4. A sole insert according to claim 1, wherein a lining of said iridescent film with said outer wall is selected from: a lining of said film on an inside wall of the outer wall; a lining of said film on an outside wall of the outer wall; and a lining of the iridescent film as sandwiched between the outer wall and a transparent back layer juxtapositioned to the outer wall.

5. A sole insert according to claim 1, wherein said air-cushioning pad further includes: a pair of color sheets disposed on an upper and a bottom side of the pad, whereby upon a molding process, the two color sheets are bonded together with the pad for forming at least an intermediate recess and an internal cell in said pad, and for backing the inner wall by said color sheet for revealing color of the color sheets.

6. A sole insert according to claim 1, wherein said air-cushioning pad includes a sac having an iridescent film sandwiched in between an outer wall and a back layer juxtapositioned to said outer wall, with the sac adhered on a socket recessed in a footwear sole, and the sole colored to form contrast color and background color in contrast to the iridescent color as reflected from the iridescent film lined in the outer wall of the sac.

7. A sole insert according to claim 6, wherein said sac is an elongate sac fixed in a socket circumferentially recessed in a brim of said footwear sole.

8. A sole insert adapted for insertion in a footwear sole comprising:

an air-cushioning pad made of transparent material and having an outer wall, an inner wall juxtapositioned to said outer wall and a sac defined between said outer and inner walls;

an iridescent film lined with said outer wall of said air-cushioning pad for forming iridescent colors from said iridescent film.

* * * * *